United States Patent [19]

Shainfeld

[11] 4,310,040

[45] Jan. 12, 1982

[54] POUCH KEY HOLDER

[76] Inventor: Oded Shainfeld, 20 Kehillath Budapest St., Tel Aviv, Israel

[21] Appl. No.: 152,678

[22] Filed: May 23, 1980

[30] Foreign Application Priority Data

Jun. 8, 1979 [IL] Israel ..... 57515

[51] Int. Cl.[3] ..... A45C 11/32

[52] U.S. Cl. ..... 150/40

[58] Field of Search ..... 150/40; 70/456

[56] References Cited

U.S. PATENT DOCUMENTS

| | | | |
|---|---|---|---|
| 1,838,554 | 12/1931 | Kahn | 150/40 |
| 2,717,621 | 9/1955 | Martin et al. | 150/40 |
| 2,800,941 | 7/1957 | Leddy | 150/40 |
| 2,897,866 | 8/1959 | Di Nolle | 150/40 |
| 3,299,930 | 1/1967 | Schumer | 150/40 |

*Primary Examiner*—George T. Hall

*Attorney, Agent, or Firm*—Browdy and Neimark

[57] ABSTRACT

A key holding pouch consisting of two T-shaped pieces of sheet material. The webs of the T-pieces are laid onto one another with the legs of the T's extending to opposite direction. Bolts or screws extend through the web portion for suspension thereon of keys.

3 Claims, 4 Drawing Figures

FIG.1
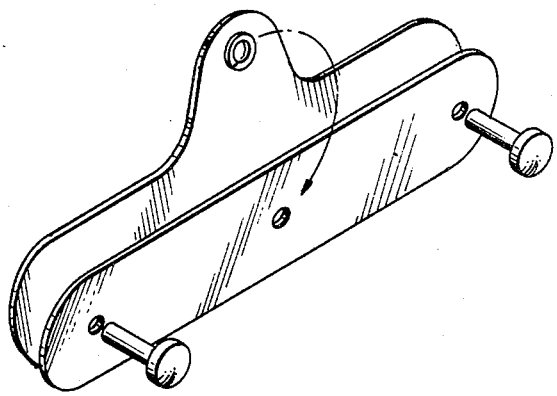
FIG.2
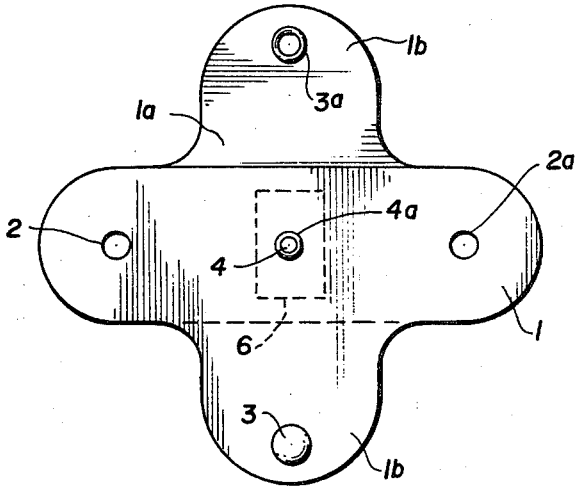
FIG.3
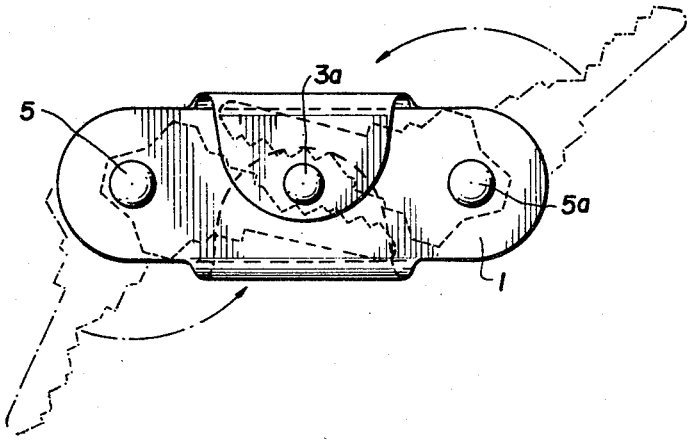
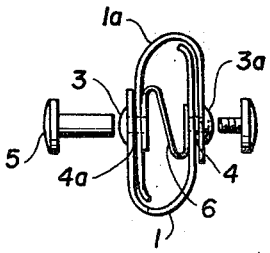
FIG.4

POUCH KEY HOLDER

FIELD OF INVENTION AND BACKGROUND

The present invention relates to a key holder and more particularly to a key holder of the pouch kind.

The conventional pouch for keys comprises a piece of plastics, leather or the like material, folded along a median line and being closed by overlapping a small tongue which extends from one edge of said piece of material, onto the other side of the folded piece. The keys are being held by one or two pins (see FIG. 1).

This kind of pouch key holder (made of one piece) has one opening created by unfolding it hence causing difficulties in inserting the keys, and also at locating a certain key. A further disadvantage is that this pouch limits the number of keys that can be inserted.

SUMMARY OF INVENTION

According to the invention the new pouch comprises two identical "T" shaped pieces of leather, plastics or the like material, said pieces being placed one on top of the other in such a manner that the horizontal webs of the "T" cover each other while the vertical "legs" extending to different directions and confronting each other form a cross with the superposed webs. Between said pieces there is provided a strip of elastic material, through the opposite ends of the two webs of the "T" two pins, screw bolts or the like are passed, at the ends of the vertical legs the female part of a press button is provided cooperating with the male part provided on the web portions.

SHORT DESCRIPTION OF DRAWINGS

These and further features of the invention will become clear from the following description which has reference to the annexed drawings.

FIG. 1 is a perspective view of the conventional known type.

FIG. 2 shows the new pouch spread out.

FIG. 3 shows the new pouch in a closed position.

FIG. 4 is an end view of FIG. 3.

DESCRIPTION OF PREFERRED EMBODIMENT

According to the invention the pouch comprises two identical "T" shaped pieces 1 and 1*a* being placed one on top of the other, the webs of the "T" lying on one another in the manner shown in FIG. 2. Each piece has two holes 2 and 2*a* at its ends. A press button is provided at each piece in such a manner that the female part 3 and 3*a* respectively is attached to the lower part 1*b* of the vertical leg of the "T" shaped piece, while the male part 4 and 4*a* respectively is attached to the upper, web part of the "T", or vice versa.

Through holes 2 and 2*a* pins or screw bolts 5 and 5*a* are passed. These screws pass also through the eyes of the keys and serve as a pivot about which the keys can be swung.

The keys are arranged in the pouch in such a manner that the narrow shank portion depending from a pin or bolt at one end of the pouch of one key 1 extends along the corresponding portion of another key depending from a pin or bolt at the opposite end of the pouch, thus complementarily usefully employing the space within the pouch.

After inserting the keys the pouch is closed in the following way: part 1*b* of one of the "T" pieces with its female part 3 of the press buttom is folded over the edge of the other "T" piece and pressed onto male part 4*a* of the press button while the second female part 3*a* of the press button is pressed onto male part 4.

The elastic strip 6 which is connected between the two "T" pieces divides the pouch into two compartments each of which has a separate opening and prevents keys from one compartment to pass to the other compartment.

I claim:

1. A pouch key holder which comprises two "T" shaped pieces of leather, plastics or the like material, said pieces being placed one on top of the other in such a manner that the horizontal webs of the "T" cover each other while the vertical "legs" extend to different directions and confront each other, there being further provided two screw bolts, pins or the like passing through the end portions of the web of the "T" pieces for the suspension therefrom of keys, as well as two sets of press buttons for closing the pouch.

2. A pouch key holder as claimed in claim 1, characterised by a strip of elastic material which is connected to said two "T" pieces.

3. A pouch key holder as claimed in claim 1, characterised thereby that two holes are provided at the opposite ends of the two webs of the "T" for the passage of screw bolts, pins or the like.

* * * * *